US010472921B2

(12) United States Patent
Barton et al.

(10) Patent No.: US 10,472,921 B2
(45) Date of Patent: Nov. 12, 2019

(54) TEMPERATURE ACTIVATED ZONAL ISOLATION PACKER DEVICE

(71) Applicant: VANGUARD OIL TOOLS & SERVICES LLC, Muscat (OM)

(72) Inventors: Len Barton, Annaberg Lungotz (AT); Mats Johansson, Gallivare (SE); Borre Loviknes, Nordfjordeid (NO)

(73) Assignee: Vanguard Oil Tools & Services LLC, Muscat (OM)

( * ) Notice: Subject to any disclaimer, the term of this patent is extended or adjusted under 35 U.S.C. 154(b) by 132 days.

(21) Appl. No.: 15/525,556

(22) PCT Filed: Nov. 17, 2015

(86) PCT No.: PCT/IB2015/058865
§ 371 (c)(1),
(2) Date: May 9, 2017

(87) PCT Pub. No.: WO2016/079662
PCT Pub. Date: May 26, 2016

(65) Prior Publication Data

US 2017/0321516 A1 Nov. 9, 2017

(30) Foreign Application Priority Data

Nov. 17, 2014 (SE) ..... 1451379

(51) Int. Cl.
*E21B 33/128* (2006.01)
*E21B 23/06* (2006.01)
*E21B 33/12* (2006.01)

(52) U.S. Cl.
CPC ..... *E21B 33/1285* (2013.01); *E21B 23/06* (2013.01); *E21B 33/1208* (2013.01); *E21B 33/128* (2013.01)

(58) Field of Classification Search
CPC .... E21B 33/128; E21B 33/1285; E21B 23/06; E21B 33/1208
See application file for complete search history.

(56) References Cited

U.S. PATENT DOCUMENTS 3,716,101 A * 2/1973 McGowen, Jr. .... E21B 33/1295 166/120
4,161,219 A 7/1979 Pringle
(Continued)

FOREIGN PATENT DOCUMENTS

| | | |
|---|---|---|
| CN | 201228536 Y | 4/2009 |
| CN | 203716918 U | 7/2014 |
| WO | 2013/090257 A1 | 6/2013 |

OTHER PUBLICATIONS

Jordanian Examination Report dated Mar. 12, 2018 for Application No. GC 2015-30407 in 4 pages.
Jordanian Examination Report dated Jul. 18, 2018 for Application No. GC 2015-30407 in 3 pages.
Chinese Office Action for Application No. 201580061974.3, dated Dec. 26, 2018, in 22 pages (including English translation).

*Primary Examiner* — Nicole Coy
(74) *Attorney, Agent, or Firm* — Knobbe, Martens, Olson & Bear, LLP

(57) ABSTRACT

The present invention relates to a packer device (1) for sealing against an inner surface of a surrounding pipe or casing string (4), preferably for isolating zones or sections in an oil well, comprising a tubing body (3) and at least one sealing element (7*a, b*), where a cylinder/piston arrangement (2) comprises a cylinder (5) having a closed volume containing a fluid, such as a gas or liquid, arranged to expand when exposed to heat thereby exerting a mechanically pressure on movable elements (12), initially locked in a fixed position by means of at least one fixing element, such as a shear member (6), and where the movable elements (12) are adapted to be released into an operative state at a predetermined axial force, exerted by the closed volume in the cylinder (5), resulting in that the at least one sealing
(Continued)

element (7*a, b*) is pressed radially outwardly in such a way that it seals the packer device (1) against the surrounding pipe-/casing string (4). The invention is achieved by that an endcap (13) is arranged to cover an internal piston (11) and minimize the area of the internal piston (11) that is exposed to the surrounding pressure in the well (PW) acting against the fluid pressure (P1) inside the cylinder (5). The invention also relates to a method for activating a packer device (1) to seal against the surface of a surrounding pipe or casing string (4) and the invention further relates to the use of such a packer device (1).

21 Claims, 8 Drawing Sheets

(56) References Cited

U.S. PATENT DOCUMENTS

| | | | | |
|---|---|---|---|---|
| 4,576,235 | A | 3/1986 | Slaughter | |
| 6,203,020 | B1 * | 3/2001 | Mireles, Jr. ..... | E21B 33/1216 277/336 |
| 7,669,661 | B2 * | 3/2010 | Johnson ..... | E21B 23/04 166/373 |
| 2015/0000936 | A1 * | 1/2015 | Nguy ..... | A61K 47/20 166/387 |

* cited by examiner

TEMPERATURE ACTIVATED ZONAL ISOLATION PACKER DEVICE

CROSS-REFERENCE TO RELATED APPLICATIONS

This application is the U.S. National Phase under 35. U.S.C. § 371 of International Application PCT/IB2015/058865, filed Nov. 17, 2015, which claims priority to Swedish Patent Application No. 1451379-0, filed Nov. 17, 2014. The disclosures of the above-described applications are hereby incorporated by reference in their entirety.

TECHNICAL FIELD

The present invention relates to a packer device for sealing a smaller production tubing against a surrounding casing, and especially intended for a cased well bore in an oil well. The packer device is used in order to seal off and isolate different zones or sections of the well, in order to facilitate the production of hydrocarbons, such as liquids or gases, or for injection of for example hot steam in a well, in order to increase the production in heavy oil applications, wherein oil has a high density.

The invention also relates to a method for activating the packer device by using thermal effect when the packer device is positioned in the well.

The invention also relates to use of a packer device in a well bore for production of hydrocarbons such as liquids or gases or for injection of for example hot steam in the well.

BACKGROUND OF THE INVENTION

It is common to drill an oil or gas well bore into and through several different zones, where the zones are generally layered horizontally. I such cases, its typical to isolate each zone from the zones above and below it by installing a packer in the well bore between the zones, surrounding a tubular element, such as a production tubing, which is used to access the various zones. Known systems for achieving this isolation commonly use inflatable packers that are filled with various fluids or cement, or mechanically expandable packers. These types of packers can be expansive and setting them in place can be complicated since electrical, hydraulic or mechanical systems are usually required for the setting operation. Other types of packer systems are also used that usually not require any additional setting operation. These systems typically consist of either swell-able elastomeric packers that react and swell when in contact with hydrocarbons, or by elastomeric cup-packers that are mounted to the tubing. Both these type of packers have their limitations when it comes to high temperature applications due to the material characteristics in the elastomers used.

Consequently, there is a need for a packer device that can be easily installed, withstand high temperatures, mechanical strain, wear and erosion and that can be manufactured and installed at a low or reasonable cost.

OBJECTS OF THE INVENTION

The object of the invention is to provide a solution to the problems mentioned above and suggest an improved packer device that can be used for sealing in a well/cased hole in such a way that one or more isolated zones are created in the well.

Another object with the present invention is to create a sealing between the production and/or injection tubing in the well and the surrounding casing.

One further object with the present invention is to provide a packer device that can be installed and activated in one single run, without the need for any additional activating equipment or procedures when positioned in the well.

One further object with the present invention is to provide a packer device that can be activated automatically when the surrounding temperature rise e.g. when steam is injected in the well.

Another object with the present invention is to provide a packer device that when installed and activated can take up a certain movement in the tubing relative the casing, for example caused by thermal expansion.

One further object with the present invention is to provide a reliable packer device that is simple to manufacture, that can be installed and run into the well in one trip and that is functional, efficient and safe to use.

These and further objects and advantages with the invention will be described below.

SUMMARY AND BENEFITS OF THE INVENTION

The mentioned objects are achieved by the present invention as defined in the independent claims 1, 21 and 22. Further embodiments of the invention are indicated in the dependent claims.

The present invention relates generally to the field of well bore zonal isolation tools and methods used in oil and gas well operations. The invention is especially suitable in high temperature applications, typically in heavy oil recovery operations where a combination of high temperature and steam injection through the tubing and into the formation (zone) requires sealing materials that can withstand the harsh environment.

The invention relates especially to a sealing device, a "packer device", primarily intended for isolation of one or more zones in a well bore especially in high temperature wells in which for example steam is injected to enhance the recovery of heavy oil. The invention, the Temperature set Zonal Isolation packer device, can be installed to the production tubing as a single unit or in multiples in defined positions, to isolate different zones in the well.

The packer device is activated by an increase in the surrounding temperature when the device is installed in the well. An integrated cylinder in the packer device is filled with a fluid, such as Nitrogen gas, that expands when heated. The force generated by the pressure increase from the heated fluid shears a set of shear members, such as shear screws, via an internal piston and after shearing, the internal piston strokes. The external piston connected to an internal piston, and the cylinder moves apart and expands two sealing elements that create a barrier towards the inside of the casing. The sealing elements are held expanded by a locking system integrated in the cylinder and/or the external piston.

A first embodiment of the present invention is thus a packer device including an activating mechanism based on using the increased pressure that a media, preferably a gas such as Nitrogen, will generate when heated in a closed volume inside the packer device.

The present invention includes a main tubular body with threaded connections at each end, which can be connected to the production/injection tubing string of a well. A cylinder with a piston arrangement is attached to the main body. Both the cylinder and the pistons are movable/slide-able axially along the main body, within fixed boundaries. The cylinder is filled at surface with a fluid/media such as a gas to a calculated pressure that increases with elevated temperature. A number of shear members are preventing the device from activating until it has been heated up when installed in the well. At least one expandable sealing element is attached to the body, positioned between the moveable external piston and a stop element at a fixed position on the body. The sealing element is expanded outwardly to the surrounding casing by means of a conically shaped piston and/or a cylinder with a conically shaped outer end, thereby creating a secure seal between the packer body and the casing.

The axial force acting on the pistons is generated by the pressure of the expanding media/fluid/gas inside the cylinder. The pressure inside the cylinder acts on an internal piston with a relatively small area exposed to the surrounding pressure in the well. The internal piston is connected to an external piston, and the axial force is transferred to the sealing element(s) once the shear members have been sheared. A locking system keeps the external piston and the cylinder in their expanded position, securing the seal between the packer device (and its body) and the casing. One or more flexible gauge rings are used at each end of the device to keep it centralized in the casing. The flexible gauge rings, made slightly larger than the maximal inner casing diameter in the original position, will also function as extrusion barriers and prevent the sealing elements from being extruded between the casing and the outer diameter of the device. When entering the casing during installation of the device, the flexible gauge rings, made from a suitable steel material, will elastically compress inwardly and during RIH always stay in contact with the casing. The function of the flexible gauge rings is similar to those of piston rings in an engine.

The cylinder of the device holds a defined volume of a media/fluid/gas that expands with elevated temperature. The preferred media is Nitrogen gas, but other media can also be used depending on the application and use. The volume of the cylinder is determined by the outer diameter of the packer body, the maximal outer diameter of the device, the length of the cylinder and the pressure rating of the device. The volume can be adapted to the media used and the application by changing the length of the cylinder.

The cylinder is closed in one end, having an axially moveable piston arrangement at the other end. The cylinder is mounted to the body in such a way that both ends of the cylinder/piston arrangement can move axially relative to the body and each other when the fluid expands. By positioning the sealing element (s) on one or both sides of the moveable cylinder/piston system and between the fixed stop element(s) or end support(s) firmly mounted to the body, the sealing element (s) will be deformed and forced/pressed out towards the casing when the cylinder/piston system expands.

To maximize the force acting on the sealing element (s), generated by the pressure in the cylinder, an internal piston is used. The internal piston is connected to an external piston through a sealed end-cap at one end of the cylinder. By doing that, the negative force generated by the surrounding pressure in the well, acting towards the force generated by the pressure in the cylinder, is reduced. The relative area exposed to the well pressure and that acts negatively on the internal piston will be relatively small compared to the area inside the cylinder acting positively.

The cylinder is fitted with two threaded and sealed plugs that are used to fill the cylinder with the preferred media/fluid/gas. The cylinder is filled at surface, to a pre-defined pressure, before being installed in the well. The pre-defined pressure is calculated for each application, and is a function of the media used, the surrounding temperature and pressure in the well and the required setting force for the sealing element.

To prevent the cylinder/piston from moving when the device is filled, a number of shear members are used. The shear members are fitted to threaded holes in the cylinder end-cap, and enters a groove in the external piston, thereby locking the two parts to each other. The number of shear members, and the material used, is selected based on the force generated by the pressure of the media filled into the cylinder multiplied by a safety factor, and the force generated by the pressure in the cylinder at elevated temperature.

The increased pressure at elevated temperature in the cylinder will generate a force that in the well will shear the shear members and allow the cylinder/pistons to expand relative to each other. A preferred material for the shear members is brass, but also other materials can be used depending on the application.

The force from the cylinder/pistons will act on the sealing element (s) that will be deformed and create a seal between the body of the device and the casing. In the fully expanded position, a locking mechanism will keep the cylinder/pistons from moving back axially, thereby keeping the setting force applied to the sealing element(s).

The locking mechanism comprises of a splitted lock ring, with internal and external threads, a corresponding external thread on the body (tubing part) and a corresponding internal thread in the external piston/cylinder. The lock ring can travel with the external piston/cylinder during activation of the device by being expanded radially. The lock ring will pass the external threads of the body as long as the cylinder/pistons are moving relative to the body. Once the cylinder/piston is in their fully expanded positions, the lock ring will prevent them from travelling back in the opposite direction. The internal thread of the piston/cylinder will force the lock ring towards the body, and the vertical portion of the threads will engage with each other to prevent the axial movement. This type of locking system is commonly used in similar down-hole tools and will not be further described.

To keep the device centralized in the casing, one or more flexible gauge rings are attached to the body at each end of the packer device. By keeping the device centralized, most of the available setting force will be transferred to the sealing element(s), and will help to make a symmetrical seal towards the casing. The flexible gauge rings are in contact with the casing, and have a function similar to a normal piston ring in an engine. The design allows for the flexible gauge rings to take up the diametrical tolerances in the casing, and they will normally always keep the physical contact to the casing.

The shape of the flexible gauge rings is designed to reduce the friction against the casing, and reduce the force needed to compress them during installation of the packer device in the well. The flexible gauge rings will also work as extrusion barriers, preventing the sealing element(s) to be extruded through the gap between the casing and the outer diameter of the packer device at high temperature and pressure in the well.

An important advantage of the present invention, and this is not previously shown/known, is that the packer device is activated when the surrounding temperature rise to a defined level. This occurs in the well e.g. when steam is injected. Therefore the packer device does not need to be activated by any other external equipment or procedure once positioned in the well. This means that a number of packer devices can be installed to the tubing and run into the well in one trip which saves time, and provides an economical way of isolating the different zones in a well.

BRIEF DESCRIPTION OF THE DRAWINGS

The invention is described in more detail with reference to non-limiting exemplifying embodiments and with reference to the accompanying drawings, in which.

DETAILED DESCRIPTION OF PREFERRED EMBODIMENTS OF THE INVENTION

FIGS. 1 through 8 illustrates different parts/embodiments of the present invention, a temperature activated, zonal isolation packer device for use in a well bore with a casing string, preferably in high-temperature applications, for isolating zones in the well. It is emphasized that the invention is in no way restricted to a packer device for a specific use, but it can be applied to any application where sealing have to be done, as long as the object of the invention is obtained.

Figure 1:
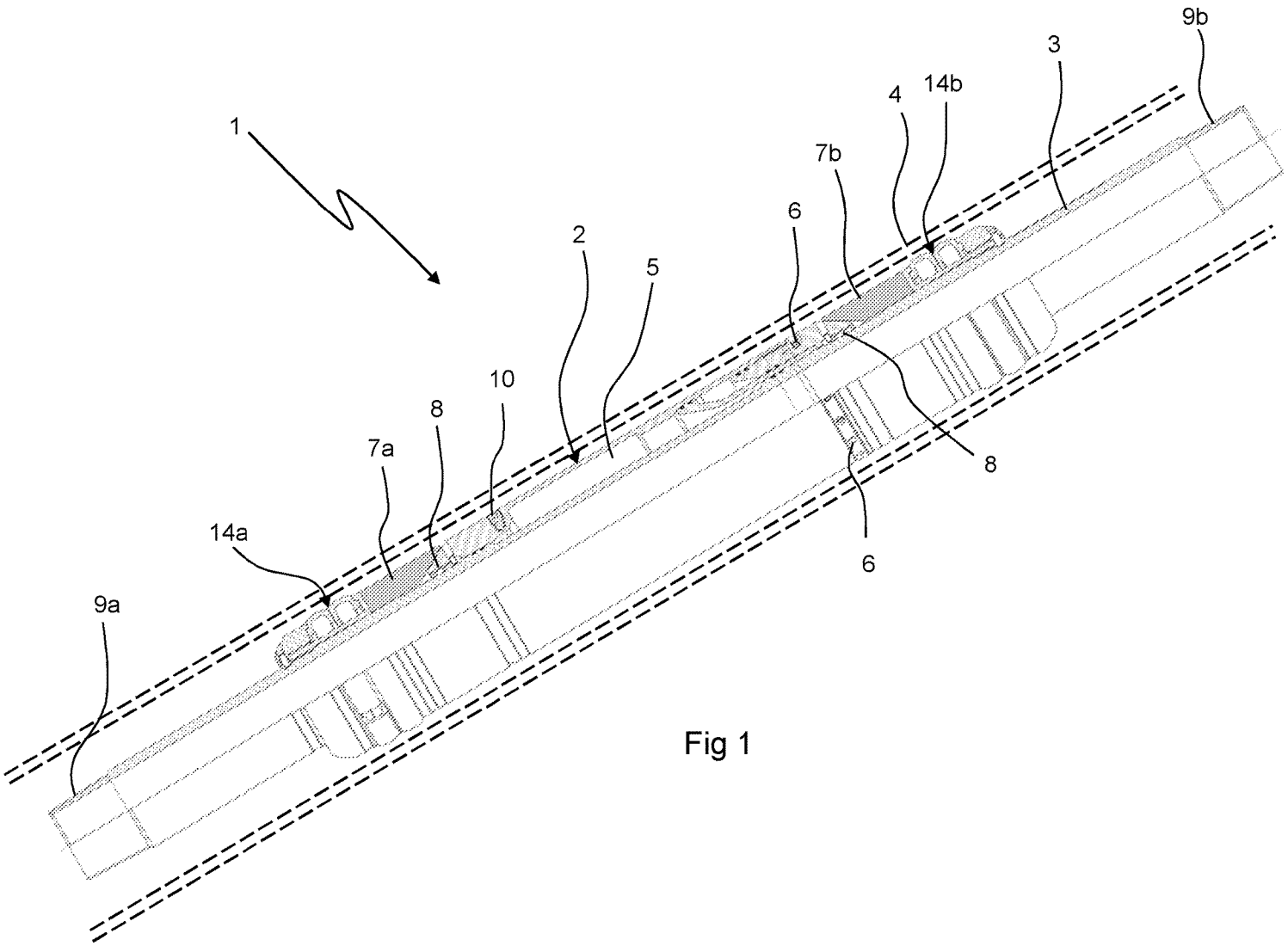
FIG. 1 is a partly sectioned view, of a packer device, indicated located in a well bore with a casing, according to a first embodiment of the present invention.

FIG. 1 is a perspective view, partially sectioned, of the present invention, the temperature activated zonal isolation packer device.

The packer device 1 according to the invention comprises of a few main components:

- a closed but expandable volume, such as a ring or collar formed cylinder/piston arrangement 2, positioned on a part of a tubing 3 located in a casing 4 and including an "cylinder" 5, filled with a fluid, such as Nitrogen gas, at a predetermined pressure, which pressure is calculated and depending on the surrounding conditions in the well, such as its temperature and pressure,
- "shear members" 6 that keeps the sliding parts of the packer device 1 in place at normal temperatures, but that shears when a predetermined force, from the heated and expanding fluid in the cylinder 5, is reached,
- one or more "sealing elements" 7*a,b* that expands and are pushed/pressed outwards radially towards the casing 4 creating a barrier or seal between the packer device 1, tubing body 3 and the casing 4, by a cylinder/piston arrangement 2, as a result of the force that the expanding fluid in the packer device 1 creates,
- a "locking system" 8 that keeps the movable parts of the packer 1 in place after the expansion, in the "set" position.
- Flexible gauge rings 14*a,b*, FGR, forms a "centralizer and/or extrusion barrier", arranged at the ends of the packer device 1 to keep it centralized in the casing 4. The flexible gauge rings 14*a,b* also works as extrusion barriers for the expanded sealing elements.

The tubing body 3 has the form of a pipe having a first end and a second end provided with threads 9*a,b* by which the packer device 1 could be connected to the overall tubing system (not illustrated) in the well.

The choice of material of the packer device 1 may depend on the mechanical and chemical environment in the actual application, but its parts are generally made of steel.

Figure 2:
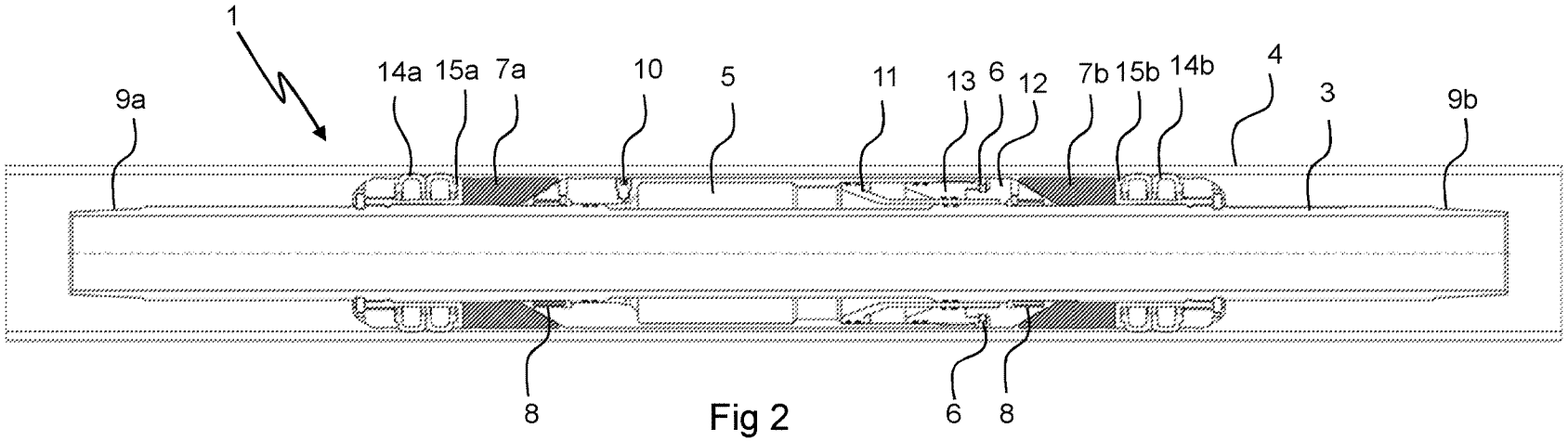
FIG. 2 is a sectioned side view of the packer device in an inactivated run in hole (RIH) position.
Figure 3:
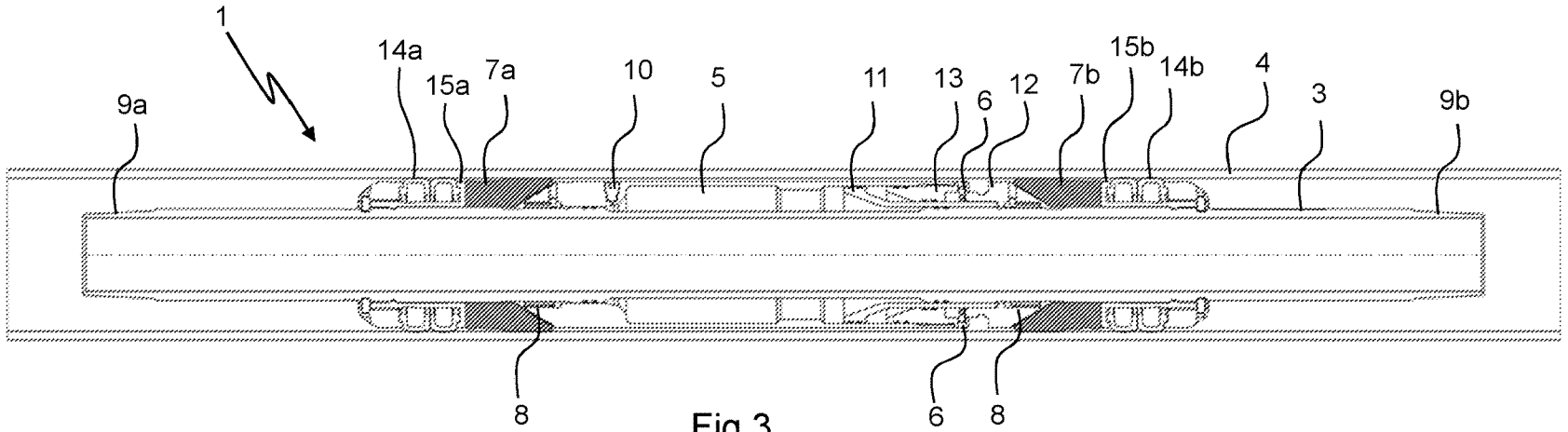
FIG. 3 is a sectioned side view, as in FIG. 2, of the packer device but in an activated (SET) and expanded position.

FIGS. 2 and 3 are sectioned side views of the packer device 1. In the figures the tubing body 3 of the packer device 1 is illustrated in its entire length. In FIG. 2 the packer device 1 is in an inactivated (RIH) position and in FIG. 3 the packer device 1 is in an activated and expanded (SET) position, where the sealing elements 7*a,b* are pressed against the inner wall of the casing 4. The packer device 1 forms a part of the overall tubing in the well and is in these figures located inside the casing string 4. The longitudinal and slide-able arranged cylinder 5 forms a closed expandable volume containing a fluid, such as Nitrogen gas. The fluid could be filled into the cylinder 5 at surface through filling plugs 10 before the packer device 1 is run into the well. The cylinder is connected to or integrated with at least one movable element such as an internal piston 11 and/or an external piston 12. The internal piston 11 is axially slide-able arranged inside the cylinder 5 and pushes against the partly conically formed external piston 12. A number of O-rings seal the movable parts to each other and to the body of the packer device 1.

The cylinder 5 and pistons 11,12 are adapted to move axially relative to each other but are held together in axial direction by shear members 6 adapted to shear when an pre-defined axial force due to the increased pressure in the cylinder 5 exceeds the total shear value of the shear members 6. When the fluid inside the cylinder 5 is exposed to the surrounding heat from e.g. hot steam injected into the well through the tubing 3, the fluid pressure within the cylinder 5 increases. At a certain force generated by the fluid pressure, the shear member 6 shears and the cylinder 5 and pistons 11,12 slides, in opposite directions from each other, thereby pressing the conically formed external piston 12 and the conically formed outer end of the cylinder 5 against, and at least partly in under the sealing elements 7*a,b*. The sealing elements 7*a,b* are pushed outwardly, from the packer device body, toward the wall of the surrounding casing 4 and seal thereby effectively the annulus between the tubing 3 and casing 4. The sealing elements 7*a,b* may be made of any resilient elastomeric or thermoplastic material or similar materials. In high temperatures or aggressive chemical environments, different types of thermoplastic combinations can be used in the sealing elements 7*a,b*.

The locking system 8 locks the cylinder 5 and/or the external piston 12 in their axially expanded positions and keeps firmly thereby the sealing elements 7*a,b* in their outwardly activated/expanded positions, even if/when the surrounding temperature of the packer device 1 is lowered, for example if the steam injecting phase comes to an end.

The number of shear members 6 and the material of the shear members 6 are adapted and calibrated to shear at a pre-defined force depending on the desired shear force value in order to give the required shearing conditions. The number of members 6 is based on a combination of the filling pressure of the fluid, the nitrogen gas, and the available force caused by the increased temperature and the air-pressure in the well. A preferred material of the shear members 6 is brass since brass has good shearing qualities. Other possible materials can be different types of steel, for example low strength or high strength steel.

Figure 4:
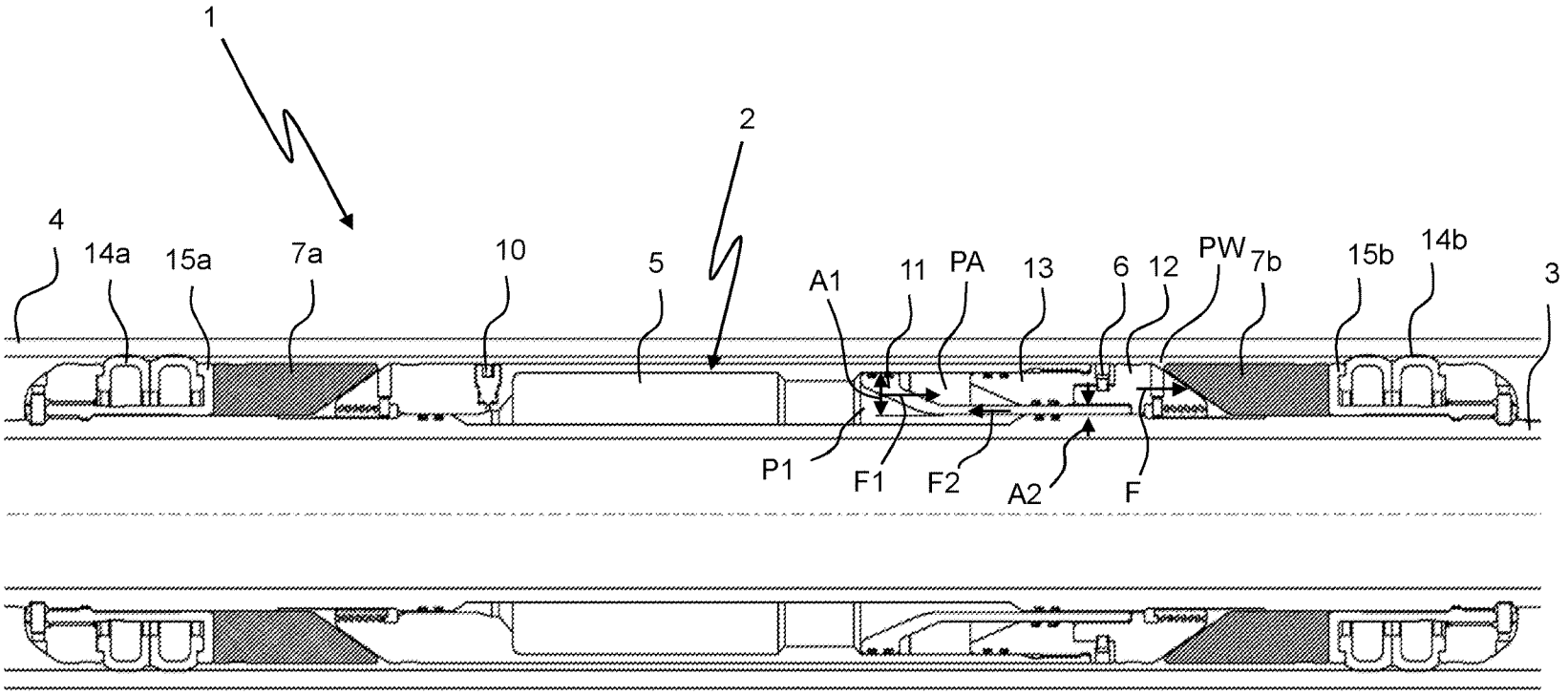
FIG. 4 is a more detailed side view of the packer device, in its inactivated (RIH) position.

FIG. 4 is for reference a more enlarged and detailed sectioned side view of the packer device 1, here illustrated in its inactivated (RIH) position. The cylinder/piston arrangement 2 comprises of four main components, the cylinder 5 itself, one end cap 13, one internal piston 11 and one external piston 12. The cylinder 5 forms the closed volume for the fluid, the gas, that when expanding acts on the internal piston 11. The end cap 13 covers/protects the internal piston 11 and the area of the internal piston 11 exposed to the well pressure is thereby minimized. This minimizes the negative effect of the well pressure acting against the fluid pressure inside the cylinder 5, resulting in a higher force acting on the internal piston 11 and external piston 12 and in the end on the sealing elements 7*a,b*.

The function of the internal piston 11 is thus to reduce the effect of the well pressure PW that will always be present in the well. The force F acting on the external piston 12 (and the sealing element 7*a*) is the sum of the forces F1 and F2 (where F2 is negative). F1 is the force generated by the pressure acting on a larger area A1 of the internal piston 11 and F2 is the force generated by the well pressure PW acting on a smaller area A2 of the internal piston 11. The important effect is that the area A2, on which the well pressure PW is acting, is minimized. The shear members 6 are dimensioned to hold for F1 (plus a safety margin) at atmospheric pressure PA, but will shear at elevated temperature that effects the packer device 1 in the well, due to the increased pressure P1 in the cylinder 5 giving a higher force F1.

Flexible gauge rings 14*a,b* (FGR) are used at the ends of the packer device 1 to keep it centralized in the casing 4, especially in more or less horizontal wells/casings 4.

Figure 5:
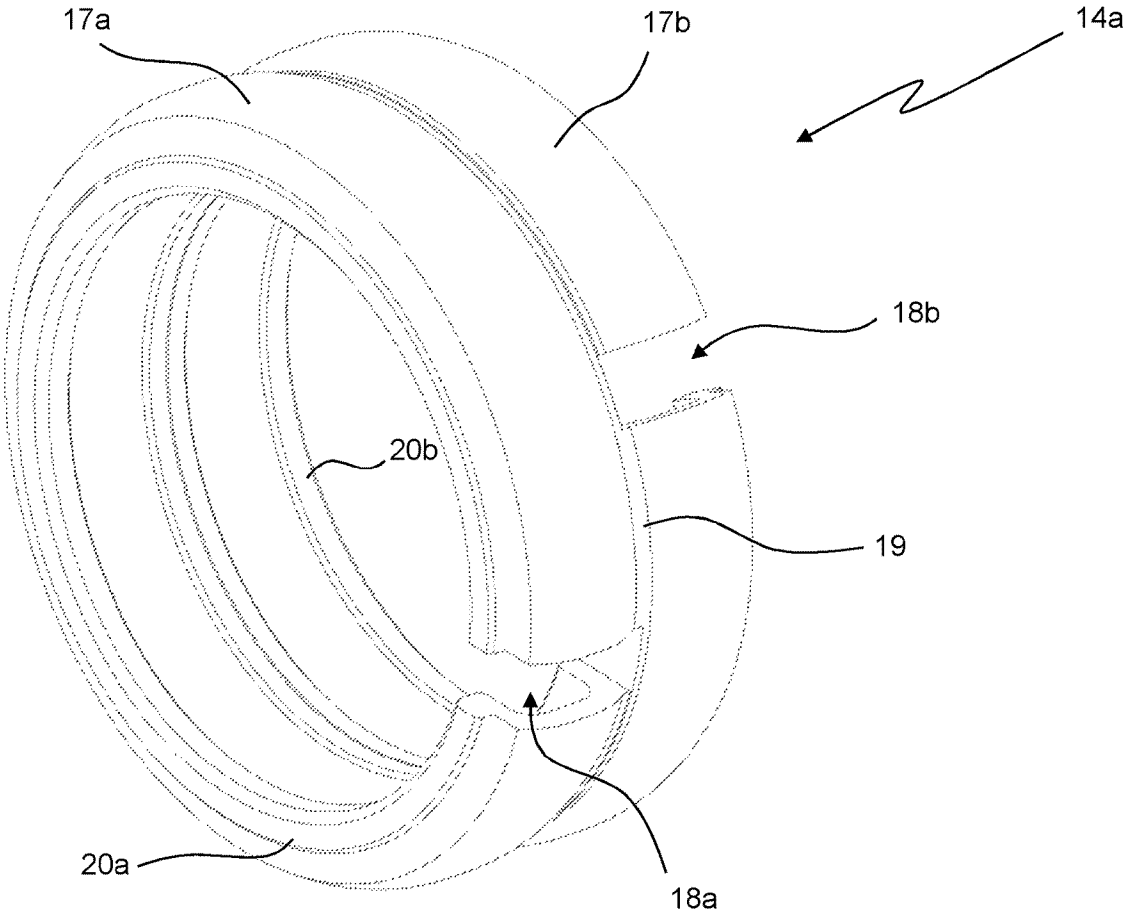
FIG. 5 illustrates one flexible gauge ring 14*a,b* more in detail.

FIG. 5 illustrates one flexible gauge ring 14*a,b* more in detail. The flexible gauge ring 14*a,b* comprises of two ring or circular formed parts 17*a,b*, each formed with a cutaway 18*a,b* in one location, which makes each circular part 17*a,b* flexible or compressible, i.e. the part 17*a,b*, and therefore the flexible gauge rings 14*a,b* diameter may vary which makes them possible to adapt to variations in the surrounding casing 4. The two parts 17*a,b*, are connected to each other at one part of their circumference, by a bridge 19. The flexible gauge rings 14*a,b* are kept centralized in the packer device 1 by two edges 20*a,b* (see FIG. 7) formed in the stop elements 15*a,b* at the end of the packer device 1.

A flange 20*a,b* on the outer side of each circular part 17*a,b* is arranged to interact with the corresponding flange 21*a,b* in the stop elements 15*a,b* in order to keep the flexible gauge rings 14*a,b* into the packer device 1 and in order for them to be able to centralize the packer device 1 in the casing 4.

The flexible gauge rings 14*a,b* are arranged with a somewhat larger outer diameter than the inner diameter of the casing 4 and the intention is that the flexible gauge rings 14*a,b* always should stay in contact with the casing 4 even if its diameter may vary.

The flexible gauge rings 14*a,b* should be dimensioned to keep the packer device 1 in the center of the casing 4 but at the same time not to execute a too large force radially outwards, against the casing 4.

The advantage of having the packer device 1 centralized in the casing 4 is that the force generated by the cylinder/piston arrangement 2 does not have to be used to lift the packer device 1, especially when located in a horizontal casing 4. This means that maximum force will be used for expanding the sealing elements 7*a,b* out to the casing, and the packer device 1 will function as intended.

The flexible gauge rings 14*a,b* also, at the same time, are arranged and works as extrusion barriers, preventing the sealing elements 7*a,b*, made of a flexible material, to extrude through the gap between the casing 4 and the packer device 1 which otherwise may happen at high temperatures and pressures.

Figure 6:
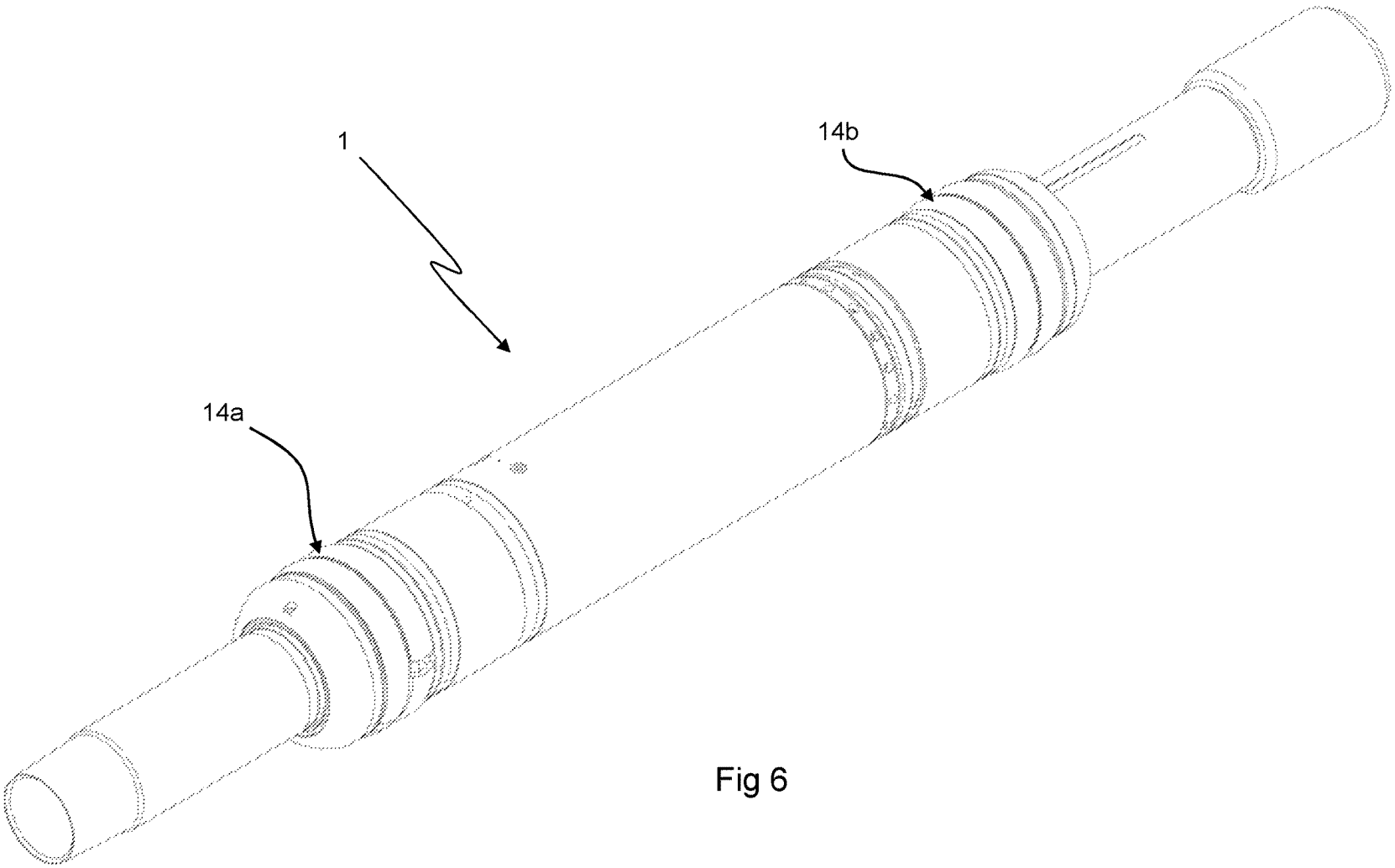
FIG. 6 illustrates the entire packer device 1 including the two flexible gauge rings 14*a, b* located near the ends of the packer device 1.

FIG. 6 illustrates the entire packer device 1 including the two flexible gauge rings 14*a,b* located near the ends of the packer device 1. The flexible gauge rings 14*a,b* keeps the packer device 1 both balanced and centralized in the casing 4, even if the packer device 1 is located in a horizontal casing 4.

Figure 7:
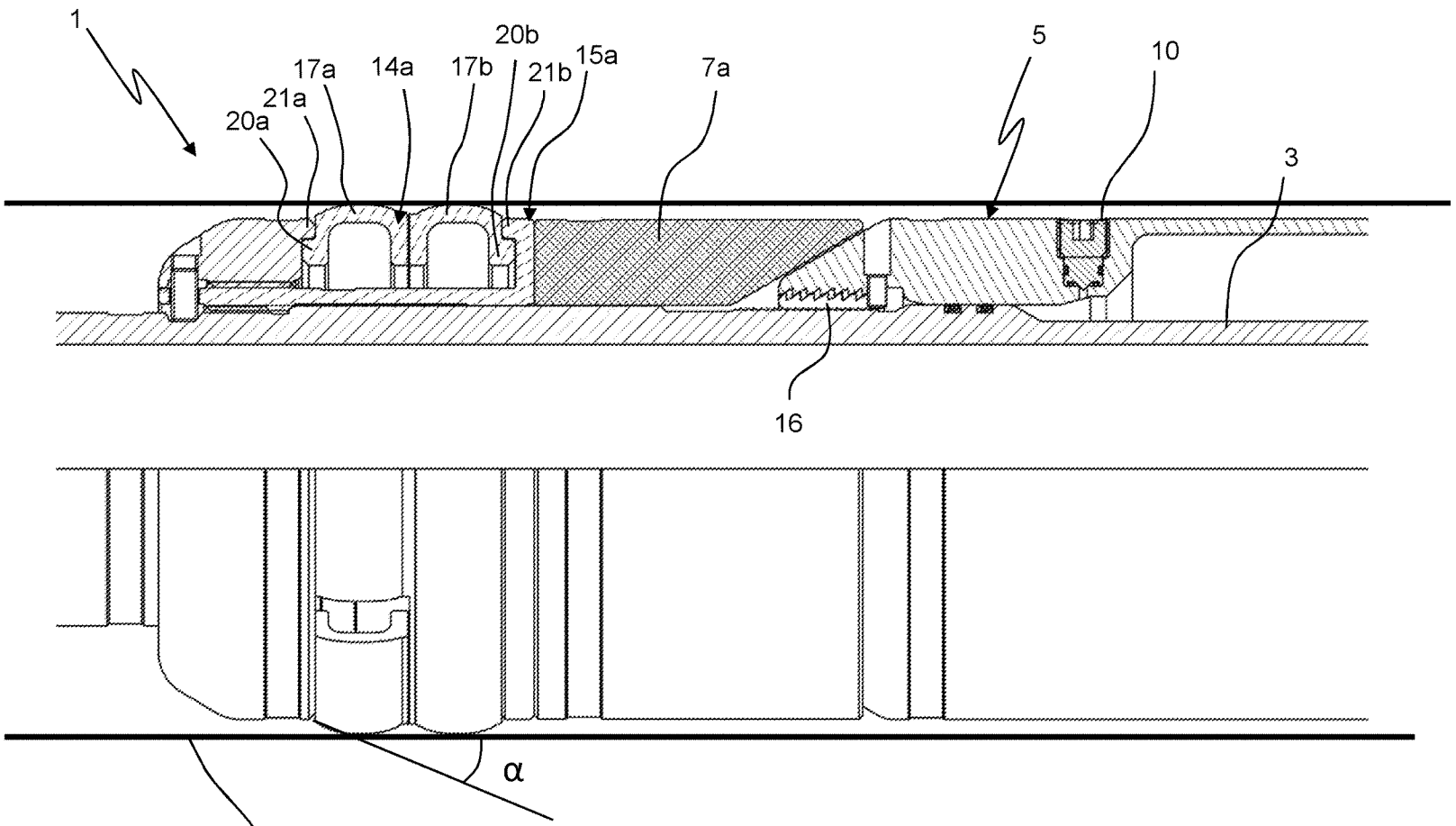
FIG. 7 is a partial side view of the packer device illustrating one of the sealing elements and the outer conical formed part of the cylinder as well as the locking system and a flexible gauge ring.

FIG. 7 is a partial side view of the packer device 1 illustrating one of the sealing elements 7*a* and the outer conical formed part of the cylinder 5 as well as the locking system 8 and a flexible gauge ring 14*a*. The sealing element 7*a* is designed with a conically formed end directed against the cylinder 5, which in turn has a conically formed outer end. This outer end of the cylinder 5 also forms part of the locking system 8 that includes a lock ring 16. On the opposite side of the sealing element 7*a* is a fixed stop element 15*a* arranged to the body 3 of the packer device 1, preventing the sealing element 7*a* to slide axially when the cylinder 5 is moving against the sealing element 7*a* exerting a mechanical force on it. The stop element 15*a,b* is here also used as a gauge ring body, keeping the flexible gauge ring 14*a,b* in place. The outer surface of the each of the two parts 17*a, b* of the flexible gauge rings 14*a, b* are formed somewhat convex in order to make it possible to install the packer device more easily in the casing 4. The angle of each such surface is arranged with a relatively small angle $\alpha$ in relation to the inner surface of the casing 4 and this result in that the packer device 1 may be installed into the casing 4 with a relatively small axial force.

Figure 8:
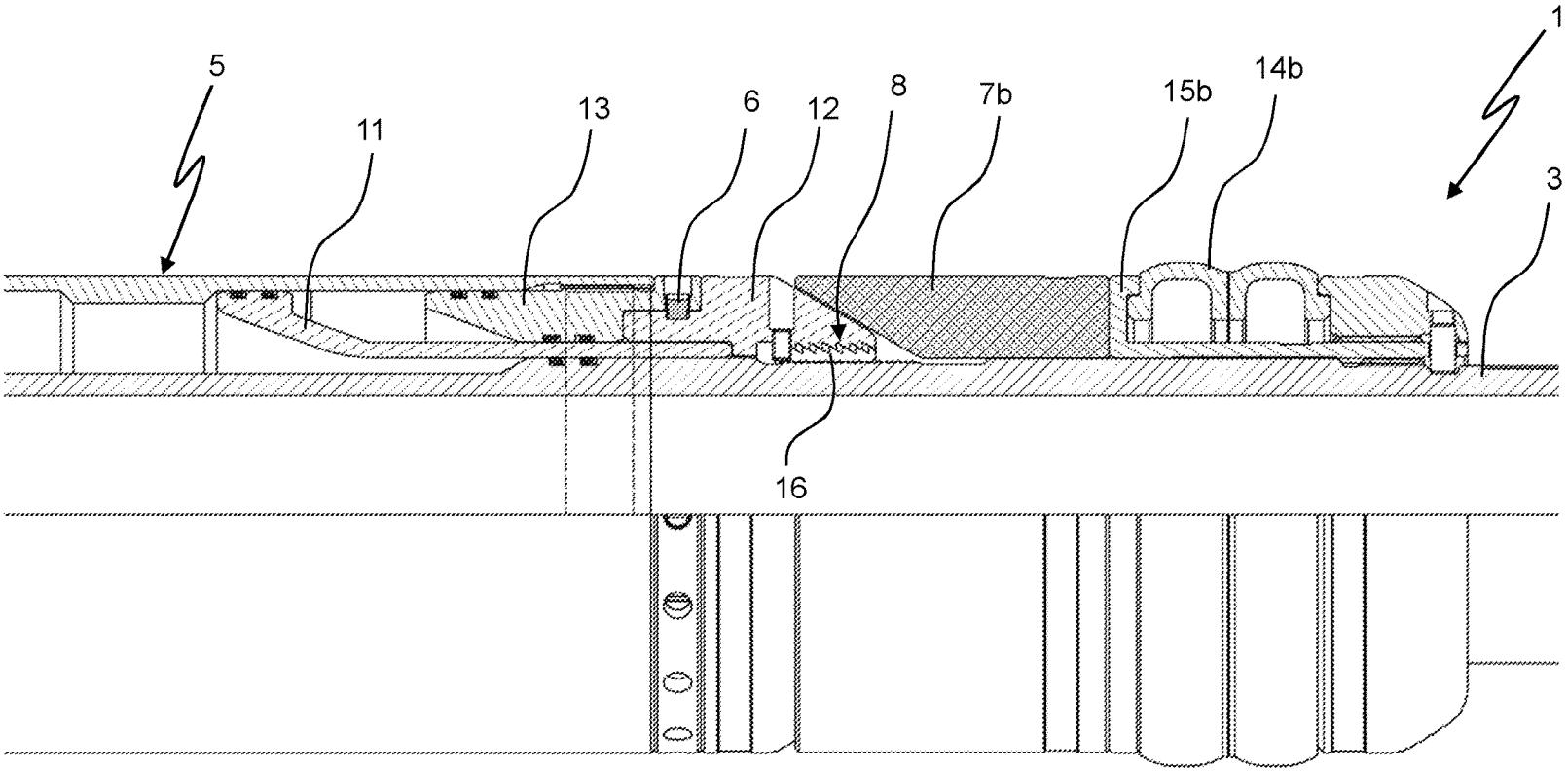
FIG. 8 is a partial side view of the packer device illustrating the other sealing element, the internal and external pistons.

FIG. 8 is a partial side view of the packer device 1 illustrating more in detail the other sealing element 7*b* and the internal piston 11 and external piston 12 as well as the shear members 6. The shear members 6 keeps the end cap 13 and the external piston 12 fixed to each other in the packer devices 1 inactivated position. On the opposite side of the sealing element 7*b* is another stop element 15*b* fixed to the body 3 of the packer device 1.

Figure 9:
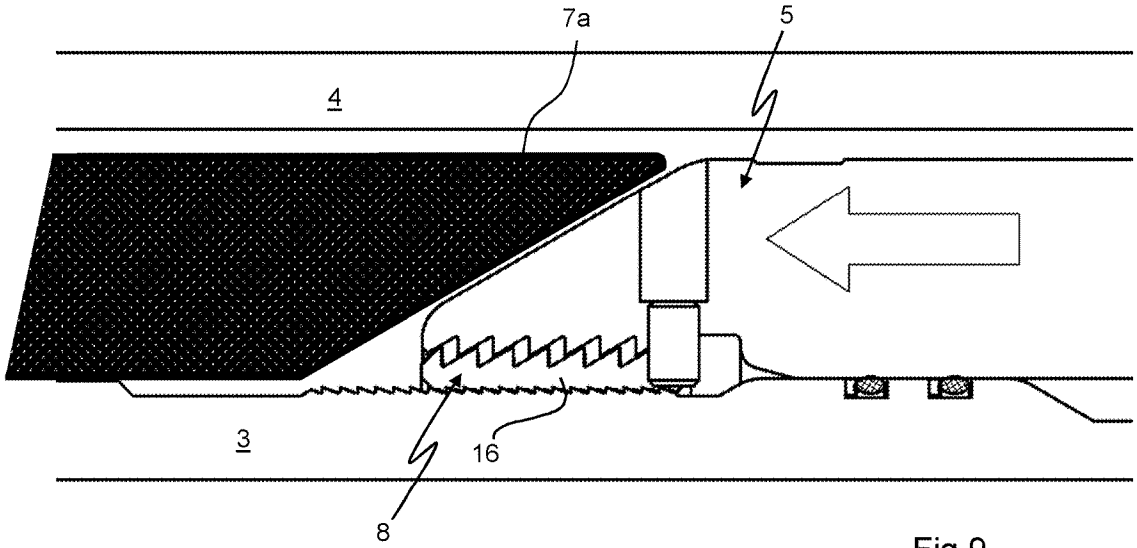
FIG. 9 is an enlarged sectioned side view of the locking mechanism which keeps the sealing element expanded once activated.

FIG. 9 is an enlarged sectioned side view of the locking system 8 which keeps the sealing element 7*a* expanded once activated. The locking system 8 consists of three elements, a splitted lock ring 16 with both internal and external threads, a fine external thread on the tubing body 3, and a larger internal thread on the cylinder 5 and the external piston 12 (not illustrated here). The lock ring 16 is splitted to allow for it to partly expand outwardly. The lock ring 16 can move axially one way with the cylinder 5 and/or the external piston 12, but is restricted to move back by the thread on the tubing body 3.

When the cylinder 5 and/or piston 12 move axially, the lock ring 16 is pushed in the same direction through mechanical contact with the external thread towards the corresponding thread in the cylinder 5 and/or piston 12. Since the lock ring 16 is splitted, it can expand, and "jump" over the threads of the tubing body 3. The internal thread of the cylinder 5 and/or piston 12 is made deep to allow for the expansion of the lock ring 16, but in such a way that it still maintain contact with the external thread of the lock ring 16 in its locked and "closed" position.

When the cylinder 5 and/or piston 12 are in the SET position, the spring-back from the expanded sealing element 7*a,b* will try to force the cylinder 5 and/or piston 12 back to their original positions. The lock ring 16 will now be pressed inwards, towards the body 3, by the internal threads in the cylinder 5 and piston 12. This will force the vertical part of the internal thread to engage with the corresponding thread of the tubing body 3 and this will lock the lock ring 16 in its position and of course also the cylinder 5 piston 12 from moving in relation to the tubing body 3 and prevent them from moving back.

Figure 10:
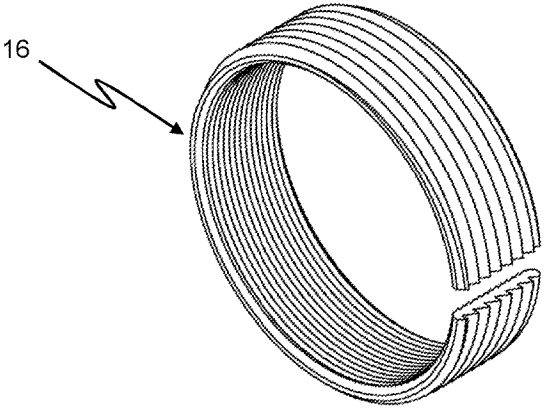
FIG. 10 is a perspective view of one part of the locking mechanism, the splitted locking ring.

FIG. 10 is a perspective view of the splitted lock ring 16 with its internal and external threads. The lock ring 16 is preferably manufactured of a material having a spring characteristic. According to one preferred embodiment, the lock ring 16 is made of steel.

The above description is primarily intended to facilitate the understanding of the invention. The invention is of course not limited to the above embodiments but also other variants of the invention are possible and conceivable within the scope of the invention and the appended claims. The invention is of course possible to use in other applications not mentioned here and the fluid used in the cylinder 5 could be any form of gas or liquid. It is also possible to use only one sealing element 7*a/b*. In that case only one of the cylinder 5 or the external piston 12 may be movable. The packer device 1 can of course also be used for other purposes and in other areas of use than those described above, such as thermal water wells or for sealing applications in pipes in general.

What is claimed is:

1. A packer device for sealing against an inner surface of a surrounding pipe or casing string, for isolating zones or sections in an oil well, said packer device comprising:

a tubing body, two expandable sealing elements, a cylinder/piston arrangement comprising a the cylinder and a movable element, wherein:

the cylinder is closed at a first end thereof, the movable element is disposed at a second end of the cylinder, and said cylinder has a closed volume containing a fluid, arranged to expand when exposed to heat, thereby expanding said closed volume to exert a mechanical pressure on the movable element, initially locked in a fixed position by at least one shear member, the movable element is adapted to be released into an operative state at a predetermined axial force from said mechanical pressure exerted by the expanding closed volume in the cylinder, resulting in that the two expandable sealing elements are pressed radially outwardly so as to seal the packer device against the surrounding pipe-/casing string, the movable element comprises:

an internal piston that is arranged inside the cylinder and which is axially movable along the tubing body, and an external piston that is connected to the internal piston and axially movable along the tubing body, the cylinder is axially movable along the tubing body, the two expandable sealing elements are attached to the tubing body and positioned one on each side of the cylinder/piston arrangement and against respective stop elements, the cylinder and the external piston are configured to move apart when the movable element is released into the operative state and the closed volume is expanded, and thereby expanding the two expandable sealing elements by means of the external piston being conically shaped and the first end of the cylinder being conically shaped, and the packer device comprises a locking system that is integrated in the cylinder and the external piston and which locking system keeps the two expandable sealing elements expanded, wherein the closed volume is defined by the cylinder and the internal piston.

2. The packer device according to claim 1, wherein the cylinder/piston arrangement is ring or collar formed and arranged on the outside and around the tubing body.

3. The packer device according to claim 1, wherein the fluid is Nitrogen gas.

4. The packer device according to claim 1, wherein said shear member is adapted to shear when an axial force, exerted by the expanding fluid in the closed volume, generating a pressure, reaches a predetermined level that exceeds the total shear value of all the installed shear members.

5. The packer device according to claim 1, wherein a number of the shear members are arranged symmetrically around the body of the packer device.

6. The packer device according to claim 1, wherein said at least one shear member is a shear screw.

7. The packer device according to claim 1, wherein the at least one shear member is made of metal.

8. The packer device according to claim 1, wherein the at least one shear member is made of steel.

9. The packer device according to claim 1, wherein the two expandable sealing elements are ring formed and located around the tubing body.

10. The packer device according to claim 1, wherein each expandable sealing element is at least partly conical shaped, at its inner side, in order to permit a matching movable element to be pressed into each expandable sealing element in order to displace it radially outwardly.

11. The packer device according to claim 1, wherein the respective stop elements are arranged on the outer side of each expandable sealing element.

12. The packer device according to claim 1, wherein the two expandable sealing elements are made of a flexible/resilient material.

13. The packer device according to claim 1, wherein the two expandable sealing elements are made of one of elastomeric, thermoplastic or a graphite composite material, or a combination thereof.

14. The packer device according to claim 1, wherein two flexible gauge rings are arranged as an centralizer/extrusion barrier in the end parts of the packer device and adapted to keep the packer device centralized in the casing string.

15. The packer device according to claim 14, wherein the flexible gauge rings are arranged as extrusion barriers preventing the two expandable sealing elements to extrude through the gap between the casing string and the packer device.

16. The packer device according to claim 14, wherein each flexible gauge ring is arranged as two circular parts connected to each other in part of their circumference by a bridge.

17. The packer device according to claim 14, wherein each circular parts having a cutaway in order to make the circular parts flexible in diameter and possible to adapt to variations in the surrounding casing.

18. The packer device according to claim 14, wherein the flexible gauge rings are made of a metal with resilient/spring properties.

19. The packer device according to claim 1, wherein an endcap is arranged to cover the internal piston and minimize the area of the internal piston that is exposed to the surrounding pressure in the well acting against the fluid pressure inside the cylinder.

20. A method for activating a packer device for sealing against an inner surface of a surrounding pipe or casing string for isolating zones or sections in an oil well, said packer device comprising:

a tubing body, two expandable sealing elements, a cylinder/piston arrangement that comprises:

a movable element which comprises an internal piston and an external piston, and a cylinder having a closed volume containing a fluid, arranged to expand when exposed to heat, thereby expanding said closed volume to exert a mechanical pressure on the movable element, initially locked in a fixed position by at least one shear member, and where the movable element is adapted to be released into an operative state at a predetermined axial force from said mechanical pressure, exerted by the expanding closed volume, resulting in that each expandable sealing element is pressed radially outwardly in so as to seal the packer device against the surrounding pipe-/casing, wherein the closed volume is defined by the cylinder and the internal piston, the method comprising:

providing the internal piston that is arranged inside the cylinder and which is axially movable along the tubing body, providing a cylinder that is axially movable along the tubing body, providing the external piston that is connected to the internal piston and axially movable along the tubing body, providing two expandable sealing elements attached to the tubing body and positioning one on each side of the cylinder/piston arrangement and against respective stop elements, moving the cylinder and the external piston apart when the internal piston and the external piston are released into the operative state and the closed volume is expanded, and thereby expanding the two sealing elements by means of the external piston being conically shaped and the cylinder having a conically shaped outer end, and keeping the sealing elements expanded by means of a locking system that is integrated in the cylinder and the external piston.

21. The packer device according to claim 20 further comprising reducing the effect of, or force from, the surrounding pressure in the well on the internal piston by enclosing the internal piston by an end cap thereby minimizing the area of the internal piston that is exposed to the surrounding pressure in the well acting against the gas pressure inside the cylinder.

* * * * *